US011146879B2

(12) United States Patent
Liu

(10) Patent No.: US 11,146,879 B2
(45) Date of Patent: Oct. 12, 2021

(54) EAR CAP AND EARPHONE

(71) Applicant: GUANGDONG OPPO MOBILE TELECOMMUNICATIONS CORP., LTD., Guangdong (CN)

(72) Inventor: Jia Liu, Guangdong (CN)

(73) Assignee: GUANGDONG OPPO MOBILE TELECOMMUNICATIONS CORP., LTD., Dongguan (CN)

( * ) Notice: Subject to any disclaimer, the term of this patent is extended or adjusted under 35 U.S.C. 154(b) by 0 days.

(21) Appl. No.: 17/000,682

(22) Filed: Aug. 24, 2020

(65) Prior Publication Data

US 2021/0092503 A1 Mar. 25, 2021

(30) Foreign Application Priority Data

Sep. 20, 2019 (CN) ..... 201921578581.1

(51) Int. Cl.
*H04R 1/10* (2006.01)

(52) U.S. Cl.
CPC ..... *H04R 1/1016* (2013.01); *H04R 1/1058* (2013.01)

(58) Field of Classification Search
CPC ..... H04R 1/10; H04R 1/1016; H04R 25/652; H04R 2225/77
See application file for complete search history.

(56) References Cited

U.S. PATENT DOCUMENTS 7,580,537 B2 * 8/2009 Urso ..... H04R 25/652 381/322
8,121,325 B2 * 2/2012 Atamaniuk ..... H04R 25/48 381/322

(Continued)

FOREIGN PATENT DOCUMENTS

CN 204616041 U 9/2015
CN 206260066 U 6/2017

(Continued)

OTHER PUBLICATIONS

Extended European Search Report issued in corresponding European application No. 20186904.7 dated Jan. 12, 2021.

(Continued)

*Primary Examiner* — Ryan Robinson
(74) *Attorney, Agent, or Firm* — Young Basile Hanlon & MacFarlane, P.C.

(57) ABSTRACT

The present disclosure provides an ear cap and an earphone including a housing and the ear cap. The housing includes a body and a connecting rod protruding from the body. The ear cap includes a cap body and a connecting member arranged in the cap body. The cap body includes a first end surface and a second end surface arranged opposite to each other. The first end surface includes a first outer edge, and the second end surface includes a second outer edge, where the distance between each point of a projection of the first outer edge on a reference plane and the second outer edge is different, where the reference plane includes a plane on which the second outer edge is located. The hardness of the connecting member is greater than that of the cap body. The connecting member is capable of being detachably connected to the connecting rod.

20 Claims, 6 Drawing Sheets

(56) References Cited

U.S. PATENT DOCUMENTS

| | | | | |
|---|---|---|---|---|
| 8,737,669 | B2 * | 5/2014 | Monahan | A61F 11/08 381/380 |
| 8,800,712 | B2 * | 8/2014 | Campbell | H04R 25/656 181/135 |
| 8,873,790 | B2 * | 10/2014 | Hayashida | H04R 1/1016 381/370 |
| 9,357,319 | B2 * | 5/2016 | Yoon | H04R 1/1041 |
| 9,432,760 | B2 * | 8/2016 | Iseberg | H04R 1/1016 |
| 9,462,366 | B2 * | 10/2016 | Silvestri | H04R 1/1016 |
| 9,955,247 | B2 * | 4/2018 | Huwe | H04R 1/1016 |
| 10,652,644 | B2 * | 5/2020 | Bruss | H04R 1/1016 |
| 10,667,030 | B2 * | 5/2020 | Wexler | H04R 1/1083 |
| 10,820,084 | B2 * | 10/2020 | Zalisk | H04R 9/063 |
| 10,999,670 | B2 * | 5/2021 | Zalisk | H04R 1/105 |
| 2013/0294634 | A1 | 11/2013 | Chen | |
| 2016/0261942 | A1 * | 9/2016 | Hayden | H04R 1/1016 |
| 2019/0007761 | A1 * | 1/2019 | Higgins | H04R 25/652 |
| 2019/0007762 | A1 * | 1/2019 | Paetsch | H04R 1/1058 |
| 2019/0166438 | A1 * | 5/2019 | Perkins | H04R 25/652 |

FOREIGN PATENT DOCUMENTS

| | | | |
|---|---|---|---|
| CN | 207184751 | U | 4/2018 |
| CN | 109104661 | A | 12/2018 |
| CN | 109792574 | A | 5/2019 |
| CN | 208863041 | U | 5/2019 |
| KR | 101363989 | B1 | 2/2014 |
| KR | 101503327 | B1 | 3/2015 |
| KR | 101562129 | B1 | 10/2015 |
| WO | 2009086555 | A1 | 7/2009 |

OTHER PUBLICATIONS

Written Opinion of the International Searching Authority issued in corresponding international application No. PCT/CN2020/103248 dated Oct. 28, 2020.

* cited by examiner

EAR CAP AND EARPHONE

CROSS-REFERENCE TO RELATED APPLICATION(S)

The present disclosure claims priority to and the benefit of Chinese Application Patent No. 201921578581.1, filed on Sep. 20, 2019, the entire disclosure of which is hereby incorporated by reference in its entirety.

TECHNICAL FIELD

The present disclosure relates to the field of earphone technology, and more particular to an ear cap and an earphone provided with the ear cap.

BACKGROUND

At present, there are various types of earphones on the market. There are two main types of earphones: in-ear earphones, and over-ear headphones. An in-ear earphone is usually provided with an earphone port and an ear cap mounted on the earphone port. In order to prevent the ear caps from being mounted incorrectly or reversely, the ear caps are often designed in a cylindrical symmetrical structure. However, the depth of the earphone port of the earphone corresponding to the ear cap having the existing symmetrical structure needs to be more than 2.5 mm to meet tension requirements of the ear cap. If the depth of the earphone port is less than 2.5 mm, poor tensile strength of the ear cap can cause it to fall off from the earphone port.

SUMMARY

The present disclosure aims to provide an ear cap and an earphone provided with the ear cap.

In order to solve the above technical problems, the present disclosure provides an ear cap capable of being detachably connected to a connecting rod of an earphone. The ear cap includes a cap body and a connecting member. The cap body includes a first end surface, a second end surface, and an outer surface connected between the first end surface and the second end surface, where the first end surface and the second end surface are arranged opposite to each other. The first end surface includes a first outer edge arranged at a joint of the first end surface and the outer surface, and the second end surface includes a second outer edge arranged at a joint of the second end surface and the outer surface. The distance between each point of a projection of the first outer edge on a reference plane and the second outer edge is different, where the reference plane includes a plane on which the second outer edge is located. The connecting member arranged in the cap body, where the hardness of the connecting member is greater than the hardness of the cap body. The connecting member is capable of being detachably connected to the connecting rod.

The present disclosure further provides an earphone which includes a housing and an ear cap. The housing includes a body and a connecting rod protruding from the body, where the connecting rod defines an earphone port. The ear cap is capable of being mounted on the connecting rod, and includes a cap body and a connecting member. The cap body includes a first end surface, a second end surface, and an outer surface connected between the first end surface and the second end surface, where the first end surface and the second end surface are arranged opposite to each other. The first end surface includes a first outer edge arranged at a joint of the first end surface and the outer surface, and the second end surface includes a second outer edge arranged at a joint of the second end surface and the outer surface. The distance between each point of a projection of the first outer edge on a reference plane and the second outer edge is different, where the reference plane includes a plane on which the second outer edge is located. The connecting member arranged in the cap body, where the hardness of the connecting member is greater than the hardness of the cap body. The connecting member is capable of being detachably connected to the connecting rod.

BRIEF DESCRIPTION OF DRAWINGS

To describe the technical solutions of the implementations of the present disclosure more clearly, the accompanying drawings required for describing the implementations are briefly introduced below. Clearly, the accompanying drawings described below are merely some implementations of the present disclosure. For those skilled in the art, other drawings can also be obtained from the accompanying drawings without paying creative work.

DETAILED DESCRIPTION

Figure 1:
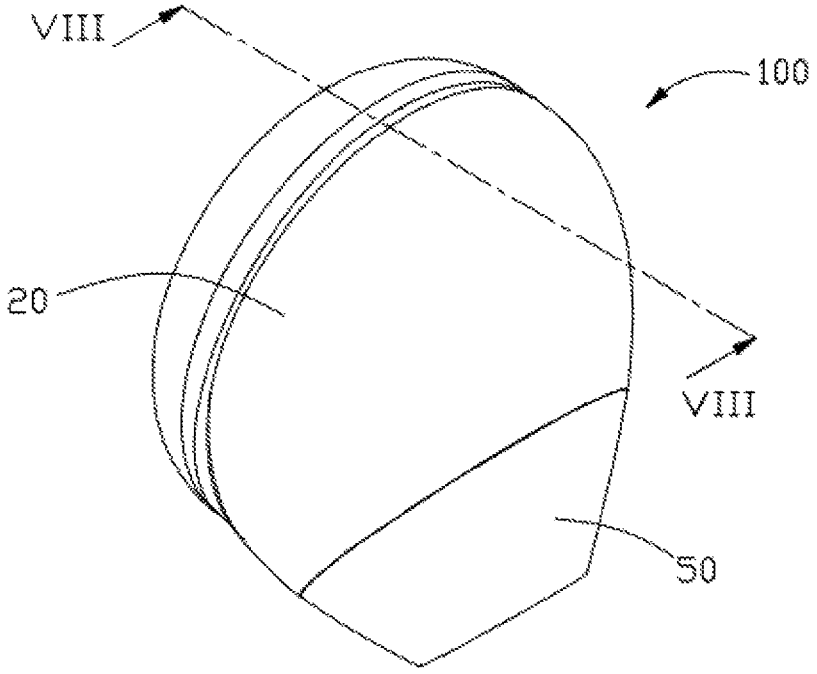
FIG. 1 is a schematic structural diagram of an earphone according to an implementation of the present disclosure.
Figure 2:
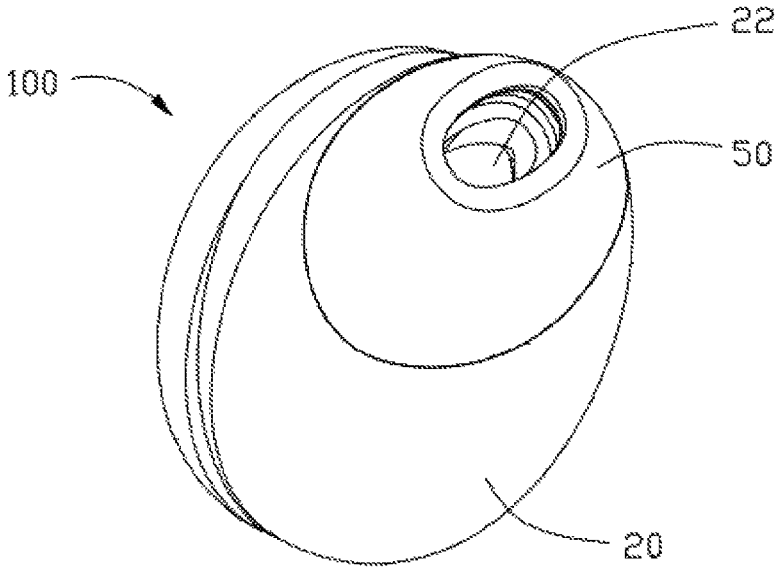
FIG. 2 is a schematic structural diagram of the earphone of FIG. 1 viewed from another perspective.
Figure 3:
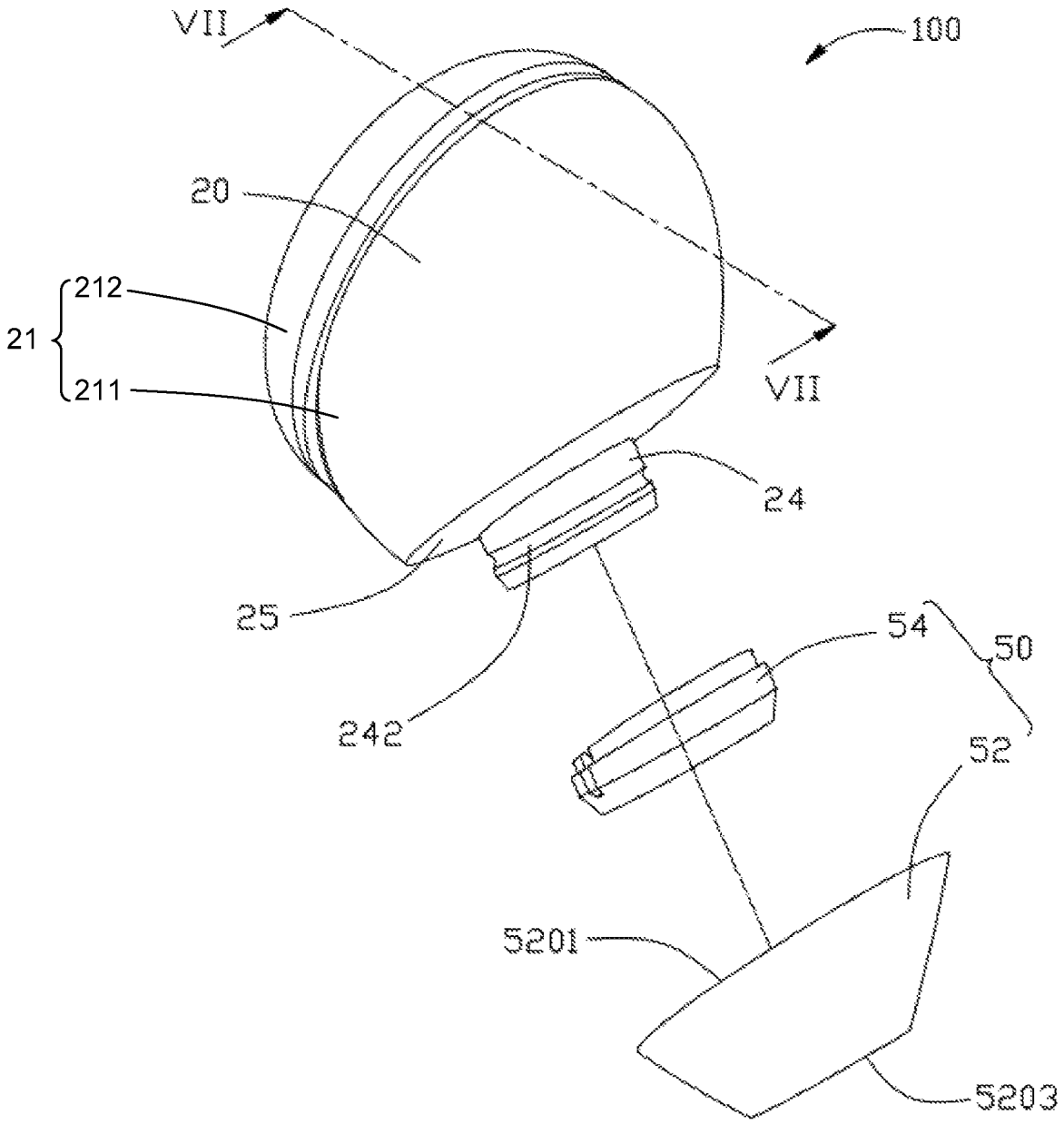
FIG. 3 is a perspective exploded view of the earphone of FIG. 1.
Figure 4:
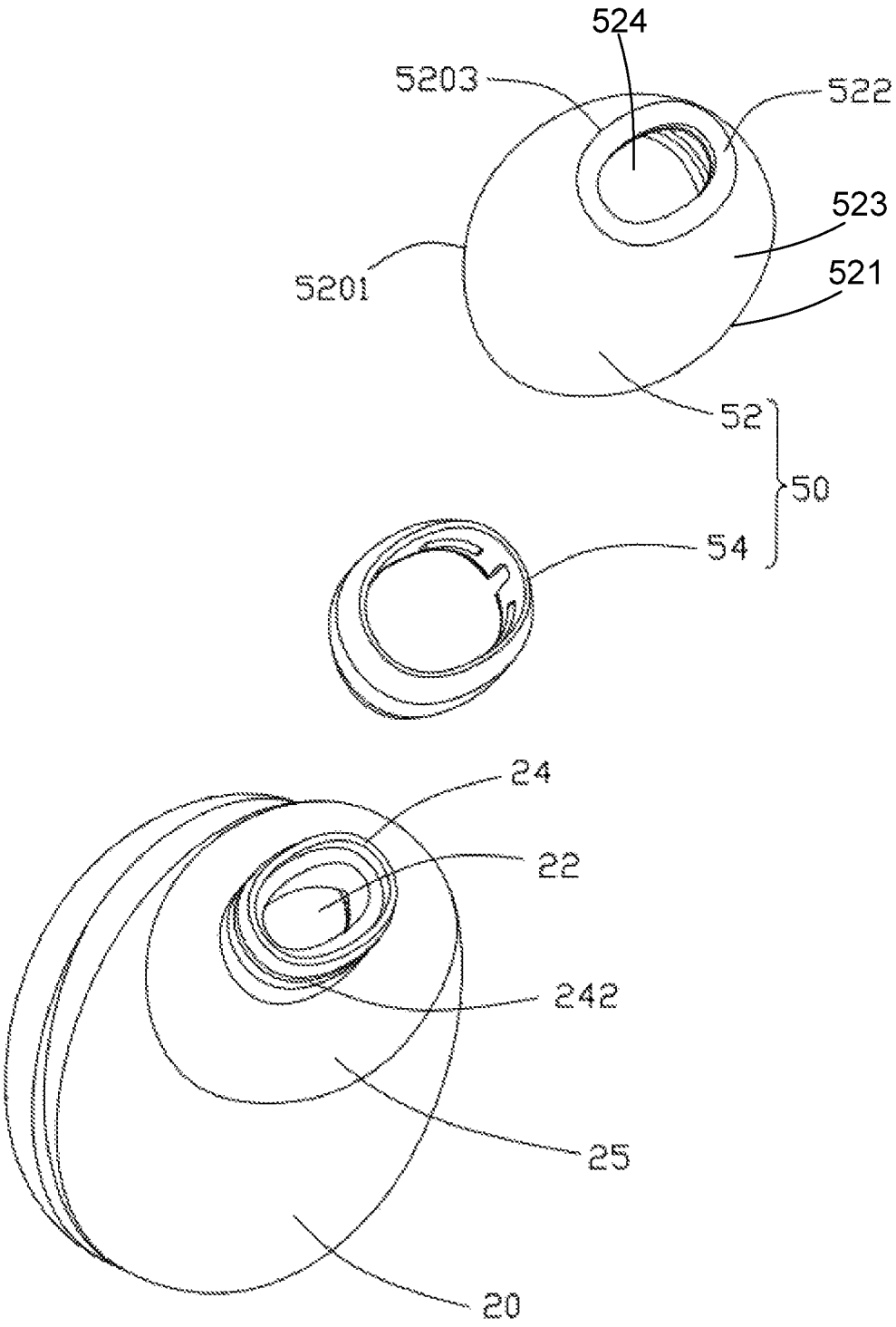
FIG. 4 is a perspective exploded view of the earphone of FIG. 2.
Figure 5:
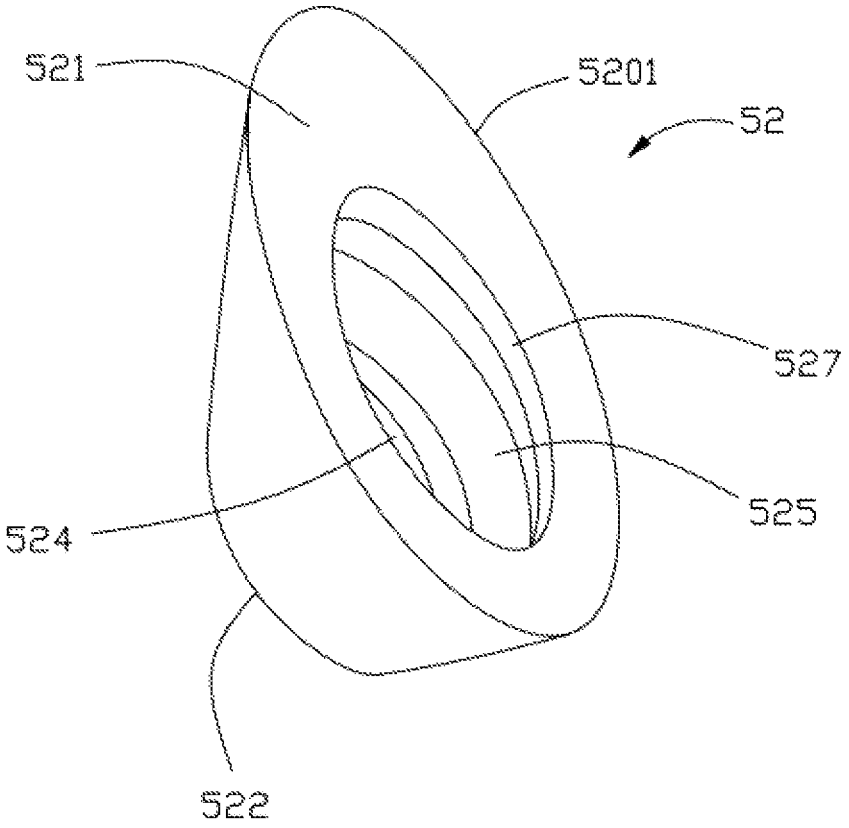
FIG. 5 is an enlarged view of a connecting member of the earphone of FIG. 3 viewed from another perspective.

The technical solutions in the implementations of the present disclosure will be clearly and completely described below with reference to the accompanying drawings in the implementations of the present disclosure. Clearly, the described implementations are only a part of the implementations of the present disclosure, but not all the implementations. Based on the implementations in the present disclosure, all other implementations obtained by those skilled in the art without paying any creative labor are within the protection scope of the present disclosure.

In addition, the descriptions of the following implementations are references to the accompanying drawings to illustrate specific implementations of the present disclosure that can be implemented. Directional terms mentioned in the present disclosure, such as “up”, “down”, “front”, “rear”, “left”, “right”, “inner”, “outer”, “side”, etc., refer only to the directions of the accompanying drawings. Therefore, the direction words are used for better and clearer description and understanding of the present disclosure, rather than indicating or implying that the device or element referred to must have a specific orientation, be constructed and operated in a specific orientation, so it cannot be understood as a limitation of the present disclosure.

In the description of the present disclosure, it should be noted that, unless otherwise clearly specified and defined, the terms “install”, “couple”, and “connect” should be understood in a broad sense. For example, it may be a fixed connection, a detachable connection, or an integrated connection; it may be a mechanical connection; it may be a direct connection, or an indirect connection through an intermediate medium, or it may be a connection between two components. For those of ordinary skill in the art, the specific meaning of the above terms in the present disclosure can be understood in specific situations.

In addition, in the description of the present disclosure, unless otherwise stated, "plurality/multiple" means two or more. If a term "process" appears in the specification, it not only refers to an independent process, but also includes the expected effect of the process if it cannot be clearly distinguished from other processes. In addition, the range of values indicated by "~" in this specification refers to the range of values described before and after "~" as a minimum value and a maximum value, respectively. In the accompanying drawings, units with similar or identical structures are denoted by the same reference numerals.

In an implementation, the present disclosure provides an ear cap capable of being detachably connected to a connecting rod of an earphone, where the connecting rod defines an earphone port. The ear cap includes a cap body and a connecting member arranged in the cap body. The cap body includes a first end surface, a second end surface, and an outer surface connected between the first end surface and the second end surface, where the first end surface and the second end surface are arranged opposite to each other. The first end surface includes a first outer edge arranged at a joint of the first end surface and the outer surface, and the second end surface includes a second outer edge arranged at a joint of the second end surface and the outer surface, where the distance between each point of a projection of the first outer edge on a reference plane and the second outer edge is different, where the reference plane includes a plane on which the second outer edge is located. The hardness of the connecting member is greater than the hardness of the cap body, where the connecting member is capable of being connected to the connecting rod.

In an implementation, the present disclosure further provides an earphone including a housing and an ear cap. The housing includes a body and a connecting rod protruding from the body, where the connecting rod defines an earphone port. The ear cap is capable of being mounted on the connecting rod. The ear cap includes a cap body and a connecting member arranged in the cap body. The cap body includes a first end surface, a second end surface, and an outer surface connected between the first end surface and the second end surface, where the first end surface and the second end surface are arranged opposite to each other. The first end surface includes a first outer edge arranged at a joint of the first end surface and the outer surface, and the second end surface includes a second outer edge arranged at a joint of the second end surface and the outer surface, where the distance between each point of a projection of the first outer edge on a reference plane and the second outer edge is different, where the reference plane includes a plane on which the second outer edge is located. The hardness of the connecting member is greater than the hardness of the cap body, where the connecting member is capable of being connected to the connecting rod.

Figure 6:
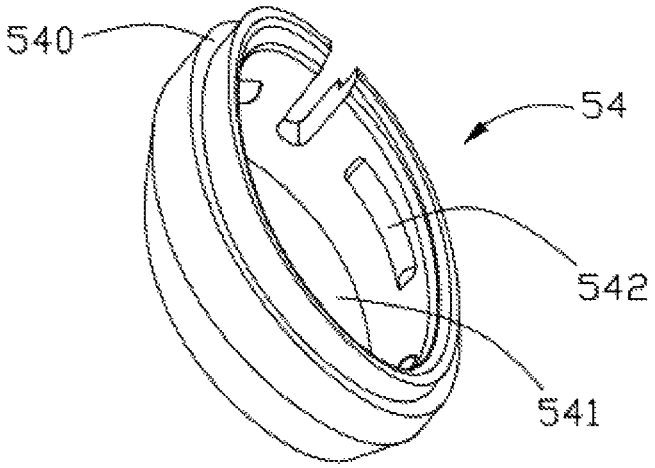
FIG. 6 is an enlarged view of a cap body of the earphone of FIG. 3 viewed from another perspective.

Referring to FIG. 1 to FIG. 4, the present disclosure provides an earphone 100 which includes a housing 20 and an ear cap 50. The housing 20 includes a body 21 and a connecting rod 24 protruding from the body 21. It can be understood that, the ear cap 50 and at least part of the body 21 are placed into an ear canal of a user when in use. The body 21 is hollow and defines a receiving cavity 203 (as illustrated in FIG. 6) therein. The connecting rod 24 defines an earphone port 22 (that is, a sound outlet) communicating with the receiving cavity 203 of the body 21. The ear cap 50 is capable of being mounted on the connecting rod 24. Specifically, the ear cap 50 is capable of being detachably connected to the connecting rod 24. The ear cap 50 includes a hollow cap body 52 and a connecting member 54 arranged in the cap body 52. The connecting member 54 is capable of being detachably connected to the connecting rod 24. The cap body 52 includes a first end surface 521, a second end surface 522, and an outer surface 523 connected between the first end surface 521 and the second end surface 522, where the first end surface 521 and the second end surface 522 are arranged opposite to each other. The cap body 52 defines a sound output channel 524 penetrating the first end surface 521 and the second end surface 522. The sound output channel 524 communicates with the earphone port 22 when the ear cap 50 is mounted on the connecting rod 24.

The first end surface 521 includes a first outer edge 5201 arranged at a joint of the first end surface 521 and the outer surface 523, and the second end surface 522 includes a second outer edge 5203 arranged at a joint of the second end surface 522 and the outer surface 523. The distance between each point of a projection of the first outer edge 5201 on a reference plane and the second outer edge 5203 is different, where the reference plane includes a plane on which the second outer edge 5203 is located.

The projection of the first outer edge 5201 on the reference plane partially overlaps or is misaligned with the second outer edge 5203. Specifically, the second outer edge 5203 may be located within an area surrounded by the projection of the first outer edge 5201 on the reference plane, the second outer edge 5203 may be located within the area surrounded by the projection of the first outer edge 5201 on the reference plane and tangent to the projection of the first outer edge 5201, or the second outer edge 5203 intersects the projection of the first outer edge 5201 on the reference plane. In the implementation, the shapes of the first outer edge 5201 and the second outer edge 5203 are both circular, the diameter of the first outer edge 5201 is greater than the diameter of the second outer edge 5203, the second outer edge 5203 is located within the area surrounded by the projection of the first outer edge 5201 on the reference plane, and a center of the second outer edge 5203 is misaligned with a center of the projection of the first outer edge 5201 on the reference plane. The cap body 52 may be a symmetrical structure or an asymmetrical structure.

The distance between each point of the projection of the first outer edge 5201 on the reference plane and the first outer edge 5201 includes a maximum value and a minimum value.

The earphone 100 provided by the present disclosure includes the housing 20 provided with the connecting rod 24 and the ear cap 50 provided with the connecting member 54. The ear cap 50 is capable of being detachably connected to the connecting rod 24 through the connecting member 54, so that the ear cap 50 is firmly mounted on the housing 20, and the ear cap 50 has strong tensile strength to prevent the ear cap 50 from detaching from the housing 20.

The housing 20 is provided with multiple components such as a multi-layer diaphragm, magnetic pole pieces, neodymium magnets, a thruster resistor for balancing the bass section to the middle section, and a rear resistor for balancing the bass section to the middle section, in the receiving cavity 203. The connecting rod 24 of the housing 20 is made of hard materials, and an extension length of the connecting rod 24 is less than or equal to 2.5 mm. The body 21 is provided with a fitting surface 25 from which the connecting rod 24 protrudes. In the implementation, the fitting surface 25 is an arc-shaped surface slightly convex outwards. The body 21 includes a front housing 211 and a rear housing 212 connected to the front housing 211. The connecting rod 24 and the fitting surface 25 are provided on the front housing 211.

The hardness of the connecting member 54 is greater than the hardness of the cap body 52. In an implementation, the cap body 52 and the connecting member 54 may be formed into one body by double injection molding. Specifically, the cap body 52 and the connecting member 54 may be formed by injection molding two different materials in the same set of molds, so that the molded ear cap 50 includes a soft cap body 52 and a hard connecting member 54. In the implementation, the cap body 52 is made of soft plastic, and the connecting member 54 is made of hard plastic.

In another implementation, the cap body 52 and the connecting member 54 may also be formed into one body by insert molding. Specifically, the connecting member 54 is formed by hard material. The connecting member 54 is first put into a mold, and then resin or molten material is injected into the mold to join and solidify the connecting member 54 to form an integrated cap body 52, so that the cap body 52 of the ear cap 50 is made of soft material and the connecting member 54 is made of a hard material.

In another implementation, the connecting member 54 and the cap body 52 may also be connected together by engagement or gluing. In the implementation, the connecting member 54 and the cap body 52 are connected together by engagement.

Referring to FIG. 3 to FIG. 7 together, the cap body 52 has an asymmetric structure. The first end surface 521 of the cap body 52 faces the housing 20 and is configured fit the fitting surface 25. In the implementation, the first end surface 521 is an arc-shaped surface slightly concave inwards. The area of the first end surface 521 is greater than the area of the second end surface 522. In the implementation, a projection of the second end surface 522 on the first end surface 521 falls into the first end surface 521. The shape of the first end surface 521 and the second end surface 522 may be circular, oval, or waist-shaped, etc., and the cap body 52 is in the shape of a circular cone. In the implementation, the shapes of the first end surface 521 and the second end surface 522 are both waist-shaped. A cross section of the cap body 52 taken along a direction from the first end surface 521 to the second end surface 522 is a non-isosceles trapezoid, that is, one of the waist sides of the cross section is longer than the other.

The cap body 52 defines the sound output channel 524 penetrating through two opposite end surfaces of the cap body 52, that is, the sound output channel 524 penetrates the first end surface 521 and the second end surface 522 of the cap body 52. The cap body 52 defines an annular receiving groove 525 on an inner wall of the sound output channel 524, and the connecting member 54 is positioned in the receiving groove 525. Specifically, the receiving groove 525 is adjacent to the first end surface 521, and the receiving groove 525 is an annular groove continuously provided along a circumferential direction of the sound output channel 524.

The cap body 52 is provided with a first connecting portion on an inner wall of the receiving groove 525, the connecting member 54 is provided with a second connecting portion on its outer wall, and the cap body 52 is detachably mounted on the connecting member 54 through an engagement of the first connecting portion and the second connecting portion. In the implementation, one of an inner wall of the receiving groove 525 of the cap body 52 and an outer wall of the connecting member 54 is protruded with a positioning strip, and the other of the inner wall of the receiving groove 525 and the outer wall of the connecting member 54 is provided with a positioning slot, where the positioning strip is snapped into the positioning slot. That is, one of the first connecting portion and the second connecting portion is a positioning strip, and the other is a positioning slot matching the positioning strip. Specifically, in the implementation, the inner wall of the receiving groove 525 is protruded with a positioning strip 527 for positioning the connecting member 54. In the implementation, the positioning strip 527 is arranged adjacent to the first end surface 521, and the positioning strip 527 is an annular strip continuously protruded along the circumferential direction of the sound output channel 524.

As illustrated in FIG. 6, the connecting member 54 has an annular structure. The outer wall of the connecting member 54 is connected to the inner wall of the receiving groove 525. An inner cavity 541 of the connecting member 54 communicates with the sound output channel 524.

Specifically, the connecting member 54 is made of hard plastic or rubber, and the outer wall of the connecting member 54 defines a positioning slot 540 corresponding to the positioning strip 527 of the cap body 52. When the connecting member 54 is received in the receiving groove 525 of the cap body 52, the positioning strip 527 is snapped into the positioning slot 540, so that the connecting member 54 and the cap body 52 are connected together.

The connecting rod 24 is provided with a third connecting portion on its outer wall, the connecting member 54 is further provided with a fourth connecting portion on its inner wall, and the connecting member 54 is capable of being detachably connected to the connecting rod 24 through an engagement of the third connecting portion and the fourth connecting portion. In the implementation, the connecting rod 24 is provided with a connecting slot 242 on its outer wall along a circumferential direction, and the connecting member 54 is provided with clamping strips 542 on its inner wall, where the clamping strips 542 is snapped into the connecting slot 242 of the connecting rod 24. That is, the third connecting portion is the connecting slot 242, and the fourth connecting portion is the clamping strips 542.

Figure 7:
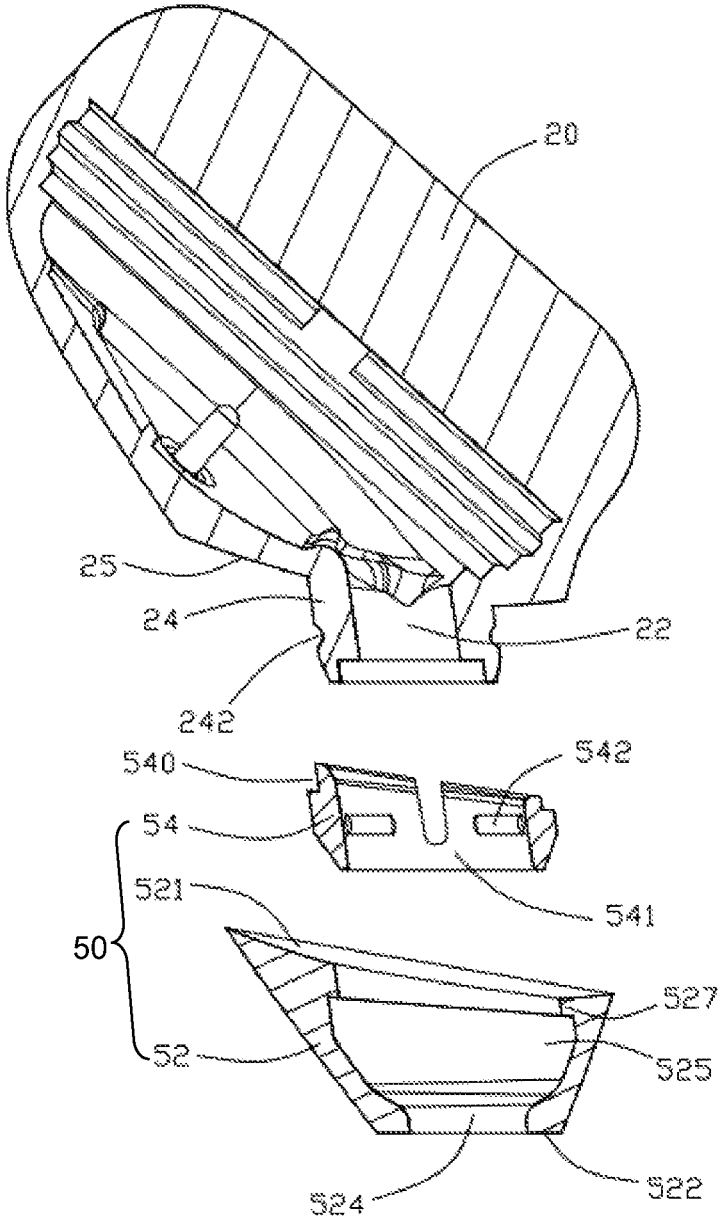
FIG. 7 is a cross-sectional view taken along a line VII-VII in FIG. 3.
Figure 8:
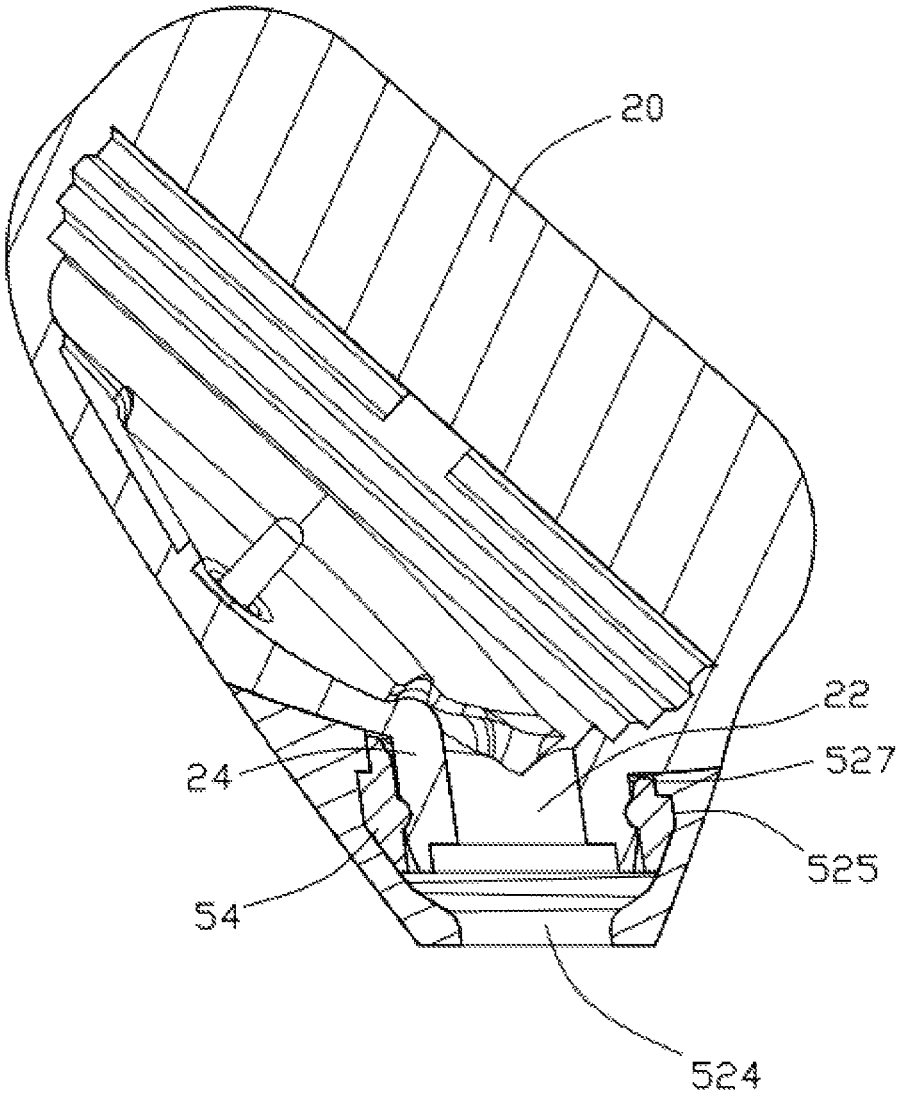
FIG. 8 is a cross-sectional view taken along a line VIII-VIII in FIG. 1.

Referring to FIG. 7 and FIG. 8 together, when assembling the earphone 100, the connecting member 54 is first received in the receiving groove 525 of the cap body 52, and the positioning strip 527 is engaged with the positioning slot 540, so that the connecting member 54 and the cap body 52 are connected together to form the ear cap 50. Then the ear cap 50 is mounted on the connecting rod 24. Specifically, the clamping strips 542 of the ear cap 50 are engaged with the connecting slot 242 of the connecting rod 24, and the first end surface 521 is fitted to the fitting surface 25. The outer surface 523 of the ear cap 50 is smoothly butted with the outer surface of the housing 20. Since the cap body 52 has an asymmetric structure, and the first end surface 521 is fit to the fitting surface 25, therefore, the ear cap 50 can only be mounted on the housing 20 according to a preset installation direction, which can prevent the ear cap 50 from being mounted reversely or incorrectly on the connecting rod 24 of the housing 20. That is, the ear cap 50 cannot be mounted on the connecting rod 24 in the case of incorrect or reverse installation by consumers, so as to avoid bringing bad use experience for the consumers. In addition, the clamping strip 542 of the ear cap 50 is engaged in the connecting slot 242 of the connecting rod 24, and both the connecting rod 24 and the connecting member 54 are made of hard material, therefore, even if the extending length of the connecting rod 24 is short, the connection between the ear cap 50 and the connecting rod 24 can also be firm and stable, so as to prevent the ear cap 50 from detaching from the connecting rod 24.

In another implementation, the outer wall of the connecting rod 24 is protruded with a clamping strip along the circumferential direction of the connecting rod 24, where the clamping strip continuously wraps the outer wall of the connecting rod 24 at least one round. The connecting member 54 defines, on its inner wall, a connecting slot corresponding to the clamping strip, where the connection groove continuously wraps the inner wall of the connecting member 54 at least one round. When the connecting member 54 is mounted on the connecting rod 24, the clamping strip of the connecting rod 24 is snapped into the connecting slot of the connecting member 54 to firmly connect the ear cap 50 to the connecting rod 24.

In another implementation, the outer wall of the connecting rod 24 is protruded with a plurality of clamping strips along the circumferential direction of the connecting rod 24, where the clamping strips circumferentially wraps the outer wall of the connecting rod 24 at least one round. The connecting member 54 defines, on its inner wall, a plurality of connecting slots corresponding to the plurality of clamping strips. When the connecting member 54 is mounted on the connecting rod 24, the clamping strips of the connecting rod 24 are snapped into the corresponding connecting slot of the connecting member 54 to firmly connect the ear cap 50 to the connecting rod 24.

In another implementation, the outer wall of the connecting rod 24 is protruded with a plurality of bumps along the circumferential direction of the connecting rod 24, and the connecting member 54 defines, on its inner wall, a plurality of connecting holes corresponding to the plurality of bumps. When the connecting member 54 is mounted on the connecting rod 24, the plurality of bumps of the connecting rod 24 are respectively snapped into the corresponding connecting holes to firmly connect the ear cap 50 to the connecting rod 24.

In another implementation, the connecting rod 24 defines a plurality of connecting holes on its outer wall along its circumferential direction, and the inner wall of the connecting member 54 is protruded with a plurality of bumps corresponding to the plurality of holes. When the connecting member 54 is mounted on the connecting rod 24, the plurality of bumps of the connecting member 54 are respectively snapped into the corresponding connecting holes to firmly connect the ear cap 50 to the connecting rod 24. In another implementation, the connecting member and the connecting rod 24 can also be connected together by glue.

In another implementation, the outer wall of the connecting member 54 is protruded with at least one positioning strip, where the at least one positioning strip wraps the outer wall of the connecting member 54 at least one round in the circumferential direction of the connecting member 54. The receiving groove 525 of the cap body 52 defines, on its inner wall, at least one positioning slot corresponding to the positioning strip, where the at least one positioning slot wraps the inner wall of the receiving groove 525 at least one round in the circumferential direction of the receiving groove 525. When the connecting member 54 is received in the receiving groove 525, the positioning strip is snapped into the positioning slot to firmly connect the connecting member 54 to the cap body 52.

In another implementation, the outer wall of the connecting member 54 is protruded with a plurality of positioning strip, where the plurality of positioning strip wraps the outer wall of the connecting member 54 at least one round in the circumferential direction of the connecting member 54. The receiving groove 525 of the cap body 52 defines, on its inner wall, a plurality of positioning slot corresponding to the positioning strip, where the plurality of positioning slot wraps the inner wall of the receiving groove 525 at least one round in the circumferential direction of the receiving groove 525. When the connecting member 54 is received in the receiving groove 525, the plurality of positioning strips are respectively snapped into the corresponding positioning slots to firmly connect the connecting member 54 to the cap body 52.

The above is the implementations of the present disclosure. It should be noted that for those of ordinary skill in the art, several improvements and modifications can be made without departing from the principles of the implementations of the present disclosure. These improvements and modifications are also considered as the protection scope of the present disclosure.

What is claimed is:

1. An ear cap capable of being detachably connected to a connecting rod of an earphone, the connecting rod defining an earphone port, and the ear cap comprising:

a cap body comprising a first end surface, a second end surface, and an outer surface connected between the first end surface and the second end surface, wherein the first end surface and the second end surface are arranged opposite to each other, wherein the first end surface comprises a first outer edge arranged at a joint of the first end surface and the outer surface, and the second end surface comprises a second outer edge arranged at a joint of the second end surface and the outer surface, wherein the distance between each point of a projection of the first outer edge on a reference plane and the second outer edge is different, wherein the reference plane comprises a plane on which the second outer edge is located; and a connecting member arranged in the cap body, wherein the hardness of the connecting member is greater than the hardness of the cap body, wherein the connecting member is capable of being detachably connected to the connecting rod.

2. The ear cap of claim 1, wherein the projection of the first outer edge on the reference plane partially overlaps or is misaligned with the second outer edge.

3. The ear cap of claim 1, wherein the cap body and the connecting member are formed into one body by double injection molding or insert molding.

4. The ear cap of claim 1, wherein the connecting member and the cap body are connected together by engagement or gluing.

5. The ear cap of claim 1, wherein the cap body defines a sound output channel penetrating the first end surface and the second end surface of the cap body, wherein the cap body defines a receiving groove on an inner wall of the sound output channel, and the connecting member is positioned in the receiving groove.

6. The ear cap of claim 5, wherein the connecting member has an annular structure, wherein an outer wall of the connecting member is connected to an inner wall of the receiving groove, and an inner cavity of the connecting member communicates with the sound output channel.

7. The ear cap of claim 6, wherein the cap body is provided with a first connecting portion on an inner wall of the receiving groove, the connecting member is provided with a second connecting portion on its outer wall, and the cap body is capable of being detachably mounted on the connecting member through an engagement of the first connecting portion and the second connecting portion, wherein one of the first connecting portion and the second connecting portion is a positioning strip, and the other of the first connecting portion and the second connecting portion is a positioning slot matching the positioning strip, wherein the positioning strip is snapped into the positioning slot.

8. The ear cap of claim 6, wherein the connecting rod is provided with a third connecting portion on its outer wall, the connecting member is provided with a fourth connecting portion on its inner wall, and the connecting member is capable of being detachably connected to the connecting rod through an engagement of the third connecting portion and the fourth connecting portion, wherein one of the third connecting portion and the fourth connecting portion is a clamping strip or a plurality of bumps, and the other of the third connecting portion and the fourth connecting portion is a connecting slot corresponding to the clamping strip or a plurality of connecting holes corresponding to the plurality of bumps.

9. The ear cap of claim 5, wherein the area of the first end surface is greater than the area of the second end surface, wherein a projection of the first end surface on the second end surface covers the second end surface.

10. The ear cap of claim 9, wherein the first end surface of the ear cap is attached to a fitting surface of the earphone from which the connecting rod protrudes.

11. The ear cap of claim 9, wherein the cap body is in the shape of a circular cone, a cross section of the cap body taken along a direction from the first end surface to the second end surface is a non-isosceles trapezoid, and one of the waist sides of the cross section is longer than the other.

12. An earphone comprising:

a housing comprising a body and a connecting rod protruding from the body, wherein the connecting rod defines an earphone port; and an ear cap capable of being mounted on the connecting rod, the ear cap comprising:

a cap body comprising a first end surface, a second end surface, and an outer surface connected between the first end surface and the second end surface, wherein the first end surface and the second end surface are arranged opposite to each other, wherein the first end surface comprises a first outer edge arranged at a joint of the first end surface and the outer surface, and the second end surface comprises a second outer edge arranged at a joint of the second end surface and the outer surface, wherein the distance between each point of a projection of the first outer edge on a reference plane and the second outer edge is different, wherein the reference plane comprises a plane on which the second outer edge is located; and a connecting member arranged in the cap body, wherein the hardness of the connecting member is greater than the hardness of the cap body, wherein the connecting member is capable of being detachably connected to the connecting rod.

13. The earphone of claim 12, wherein the projection of the first outer edge on the reference plane partially overlaps or is misaligned with the second outer edge.

14. The earphone of claim 12, wherein the cap body defines a sound output channel penetrating the first end surface and the second end surface of the cap body, wherein the cap body defines a receiving groove on an inner wall of the sound output channel, and the connecting member is positioned in the receiving groove.

15. The earphone of claim 14, wherein the cap body is provided with a first connecting portion on an inner wall of the receiving groove, the connecting member is provided with a second connecting portion on its outer wall, and the cap body is capable of being detachably mounted on the connecting member through an engagement of the first connecting portion and the second connecting portion, wherein one of the first connecting portion and the second connecting portion is a positioning strip, and the other of the first connecting portion and the second connecting portion is a positioning slot matching the positioning strip, wherein the positioning strip is snapped into the positioning slot.

16. The earphone of claim 14, wherein the connecting rod is provided with a third connecting portion on its outer wall, the connecting member is provided with a fourth connecting portion on its inner wall, and the connecting member is capable of being detachably connected to the connecting rod through an engagement of the third connecting portion and the fourth connecting portion, wherein one of the third connecting portion and the fourth connecting portion is a clamping strip or a plurality of bumps, and the other of the third connecting portion and the fourth connecting portion is a connecting slot corresponding to the clamping strip or a plurality of connecting holes corresponding to the plurality of bumps.

17. The earphone of claim 12, wherein an extension length of the connecting rod is less than or equal to 2.5 mm.

18. The earphone of claim 12, wherein the connecting rod is made of hard materials, and the connecting member of the ear cap is made of hard materials.

19. The earphone of claim 12, wherein the housing is provided with a fitting surface from which the connecting rod protrudes, and the first end surface of the ear cap is attached to the fitting surface, wherein the outer surface of the ear cap is smoothly butted with the outer surface of the housing, wherein the fitting surface is an arc-shaped surface slightly convex outwards, and the first end surface is an arc-shaped surface slightly concave inwards.

20. The earphone of claim 12, wherein the cap body defines a sound output channel penetrating the first end surface and the second end surface of the cap body, wherein the sound output channel communicates with the earphone port when the ear cap is mounted on the connecting rod.

* * * * *